US010815598B2

(12) United States Patent
Zhang et al.

(10) Patent No.: US 10,815,598 B2
(45) Date of Patent: Oct. 27, 2020

(54) DOOR FOR DRUM WASHING MACHINE, AND DRUM WASHING MACHINE

(71) Applicant: QINGDAO HAIER DRUM WASHING MACHINE CO., LTD., Shandong (CN)

(72) Inventors: Huacheng Zhang, Shandong (CN); Zongyuan Weng, Shandong (CN); Zhiqiang Zhang, Shandong (CN); Qidui Liang, Shandong (CN)

(73) Assignee: QINGDAO HAIER DRUM WASHING MACHINE CO., LTD., Shandong (CN)

( * ) Notice: Subject to any disclaimer, the term of this patent is extended or adjusted under 35 U.S.C. 154(b) by 421 days.

(21) Appl. No.: 15/576,335

(22) PCT Filed: Nov. 23, 2015

(86) PCT No.: PCT/CN2015/095302
§ 371 (c)(1),
(2) Date: Nov. 22, 2017

(87) PCT Pub. No.: WO2016/188064
PCT Pub. Date: Dec. 1, 2016

(65) Prior Publication Data

US 2018/0163333 A1 Jun. 14, 2018

(30) Foreign Application Priority Data

May 22, 2015 (CN) ..... 2015 1 0267581
May 22, 2015 (CN) ..... 2015 1 0268012

(51) Int. Cl.
*D06F 37/10* (2006.01)
*D06F 37/28* (2006.01)
*D06F 39/14* (2006.01)

(52) U.S. Cl.
CPC ..... *D06F 37/10* (2013.01); *D06F 37/28* (2013.01); *D06F 39/14* (2013.01)

(58) Field of Classification Search
CPC ..... D06F 37/10; D06F 37/28; D06F 39/14
(Continued)

(56) References Cited

U.S. PATENT DOCUMENTS 8,127,464 B2 3/2012 Schöne
2011/0023316 A1 2/2011 Schöne

FOREIGN PATENT DOCUMENTS

CN 1880562 A 12/2006
CN 1928199 A 3/2007
(Continued)

OTHER PUBLICATIONS

Wang et al., "CN104372569A English Machine Translation.pdf", Feb. 25, 2015—Machine translation from Espacenet.com.*
(Continued)

*Primary Examiner* — Levon J Shahinian
(74) *Attorney, Agent, or Firm* — Buchanan Ingersoll & Rooney PC

(57) ABSTRACT

A door for a drum washing machine comprises an inner frame, a glass tub, a middle frame, a window screen and an outer frame which are arranged sequentially from the inner side of the door to the outer side of the door. The middle frame is in welded connection with the inner frame, the glass tub is clamped between the inner frame and the middle frame, the outer frame is in snapped connection with the middle frame and/or the inner frame, and the window screen is clamped between the outer frame and the middle frame. The window screen is free of snap jaw, so that the structure is simplified, and production of the window screen is accelerated.

18 Claims, 13 Drawing Sheets

(58) Field of Classification Search
USPC ..... 68/12.26, 196, 212
See application file for complete search history.

(56) References Cited

FOREIGN PATENT DOCUMENTS

| | | | |
|---|---|---|---|
| CN | 202898808 | U | 4/2013 |
| CN | 104372569 | A | 2/2015 |
| EP | 1 386 994 | A1 | 2/2004 |
| JP | 2012-075689 | A | 4/2012 |
| WO | WO 2011/012593 | A1 | 2/2011 |

OTHER PUBLICATIONS

International Search Report (PCT/ISA/210) dated Feb. 29, 2016, by the Chinese Patent Office as the International Searching Authority for International Application No. PCT/CN2015/095302.
Written Opinion (PCT/ISA/237) dated Feb. 29, 2016, by the Chinese Patent Office as the International Searching Authority for International Application No. PCT/CN2015/095302.
Extended European Search Report dated Apr. 20, 2018, issued by the European Patent Office in corresponding European Application No. 15893132.9. (6 pages).

* cited by examiner

DOOR FOR DRUM WASHING MACHINE, AND DRUM WASHING MACHINE

TECHNICAL FIELD

The present disclosure relates to the field of washing machines, in particular to a door for a drum washing machine and a drum washing machine with the door.

BACKGROUND

A washing machine door is a common fitting of a drum washing machine and plays a role in preventing water in a rotary drum from overflowing and facilitating the observation of a running status of the washing machine by users anytime.

A door assembly structure of a drum washing machine and an assembly method are disclosed by a Chinese Patent with the publication number CN 1880562 A. The door assembly structure of the drum washing machine comprises an inclined upper hood, a central hood, a lower hood and door glass, wherein the central portion of the upper hood sinks according to certain depth, the central hood is bonded to the lower side of the upper hood, the lower hood is bonded to the lower side of the central hood, and the door glass is inserted between the upper hood and the lower hood. The door assembly method of the drum washing machine comprises a stage of bonding the central hood to the lower side of the upper hood, a stage of inserting the door glass to the lower side of the inner peripheral face of the upper hood and a stage of bonding the lower hood to the lower side of the central hood. Known from the above-mentioned document, an assembly process for the upper hood, the central hood, the lower hood and the door glass is tedious, mechanization is inconvenient to adopt, and the efficiency of assembly is relatively low. The upper hood and the lower hood cannot be matched according to demands of different users, visual perception of different users is hard to meet; the door glass is only fixed in a snapped connection mode, and thus the reliability and durability are lower.

A patent with the application number of 201310351290.X discloses a door for a drum washing machine. The door for the drum washing machine comprises an inner frame, a transparent tub, a middle frame and an outer frame which are arranged sequentially from the inner side of the door to the outer side of the door. Wherein a window screen is arranged between the outer frame and the middle frame, the middle frame is in welded connection with the inner frame, the outer frame and the window screen are snapped onto the middle frame, and a decorative part is arranged between the window screen and the middle frame. The door is compact in structure, mechanized assembly is facilitated, all components can be flexibly combined and selected, and user-friendly requirements of different users can be met. Snap jaw structures are arranged at the edge of the window screen, the snap jaw are prone to fracture during demolding and pickup in an injection molding production process due to material fragility and weaker strength, and the efficiency of production of the window screen is affected; and if snap jaw are cancelled, the production efficiency is effectively increased. However, the window screen is snapped onto the middle frame through the snap jaw, size control requirements on the window screen component and the middle frame component are very high. And difficulty in assembly and even snap jaw fracture will be caused in case of slight deviation, and thus, the efficiency of assembly is affected. Meanwhile, even if the two components are qualified in size, all the snap jaw are required to be aligned with corresponding snap groove and be connected in a snap-in manner one by one during assembly, thus, the efficiency is affected. And the window screen is snapped onto the middle frame through the snap jaw, thus, influence of attenuation or damage to weld strength of the middle frame and the inner frame is caused due to the fact that the snap jaw at the edge of the window screen will apply a large pulling force to the middle frame when the window screen is pressed during transportation or carrying-on-back.

In view of foregoing, the present disclosure is provided.

SUMMARY

An object of the present disclosure is to overcome defects in the prior art and provide a door for a drum washing machine and a drum washing machine with the door.

In order to achieve the object, the present disclosure adopts a technical scheme as follows: a door for a drum washing machine comprising an inner frame, a glass tub, a middle frame, a window screen and an outer frame which are arranged sequentially from the inner side of the door to the outer side of the door. Wherein the middle frame is in welded connection with the inner frame, the glass tub is clamped between the inner frame and the middle frame, the outer frame is in snapped connection with the middle frame and/or the inner frame, and the window screen is clamped between the outer frame and the middle frame.

The middle frame and the inner frame are matched with each other to form a first snap groove, and a first snap jaw is arranged on the outer frame and is in snapped connection with the first snap groove to connect the outer frame, and the middle frame and the inner frame together.

A first recess is formed at an outer circumference of a surface, facing the middle frame, of the inner frame. A second recess is formed at an outer circumference of a surface, facing the inner frame, of the middle frame. The first recess and the second recess are aligned with each other to form the first snap groove, of which openings face the circumference, after the middle frame is connected with the inner frame. And the first snap jaw is arranged at the outer circumference of the outer frame and are in snapped connection with the first snap groove formed by the inner frame and the middle frame.

A decorative part is further arranged between the middle frame and the window screen and is in snapped connection with the middle frame.

A first positioning structure for the window screen is arranged on the middle frame/decorative part, a second positioning structure is arranged on the window screen, and the first positioning structure and the second positioning structure are matched with each other for positioning.

A second snap jaw/a second snap groove is arranged on a surface, facing the middle frame, of the decorative part. A second snap groove/a second snap jaw is formed in a surface, facing the decorative part, of the middle frame, and the second snap jaw/second snap groove is in snapped connection with the second snap groove/second snap jaw.

A first projection structure is arranged between the decorative part and the window screen, a top end of the first projection structure supports the decorative part or the window screen. Preferably, a plurality of dispersedly convex points are arranged on the outer edge of a surface, facing the window screen, of the decorative part, and the top end of the first projection structure is abutted against the window screen.

The external surface of the inner frame bulges outwards, a groove-shaped handle is formed on the internal surface of the inner frame, a notch is formed in the middle frame at a position corresponding to the position of the handle, and the handle of the inner frame is matched with the decorative part through the notch.

A second projection structure is dispersedly arranged between the handle and the decorative part, and a top end of the second projection structure support the handle or decorative part.

The present disclosure further provides a drum washing machine with the door.

The door for the drum washing machine comprises an inner frame, a glass tub, a middle frame, a window screen and an outer frame which are arranged sequentially from the inner side of the door to the outer side of the door. Wherein the middle frame is in welded connection with the inner frame, the glass tub is clamped between the inner frame and the middle frame, the outer frame is in snapped connection with the middle frame and/or the inner frame, the window screen is in snapped connection with the middle frame, a snap connecting structure which is in snapped connection with the middle frame are arranged on the outer periphery of a surface, facing the middle frame, of the window screen, and a groove-shaped gap is formed between adjacent snap connecting structures.

The groove-shaped gap is formed by removing circumference parts, between adjacent snap connecting structures, of the window screen, or is formed by the snap connecting structure extending out of the circumference part of the window screen.

The snap connecting structure extends into the middle frame and is in snapped connection with the middle frame, and an edge of the groove-shaped gap supports the outer frame.

A third snap jaw/a third snap groove is arranged at the outer periphery of a surface, facing the middle frame, of the window screen. The third snap groove/the third snap jaw is formed in the outer periphery of a surface, facing the window screen, of the middle frame, and the third snap jaw/the third snap groove is in snapped connection with the third snap groove/third snap jaw.

The middle frame and the inner frame are matched with each other to form the first snap groove, and the first snap jaw is arranged on the outer frame and is in snapped connection with the first snap groove to connect the outer frame, and the middle frame and the inner frame together.

A first recess is formed at the outer circumference of a surface, facing the middle frame, of the inner frame. A second recess is formed at the outer circumference of a surface, facing the inner frame, of the middle frame. The first recess and the second recess are aligned with each other to form the first snap groove, of which opening faces the circumference, after the middle frame is connected with the inner frame. And the first snap jaw is arranged at the outer circumference of the outer frame and is in snapped connection with the first snap groove formed by the inner frame and the middle frame.

A decorative part is further arranged between the middle frame and the window screen and is in snapped connection with the middle frame. A first projection structure is arranged between the decorative part and the window screen, a top end of the first projection structure supports the decorative part or window screen. Preferably, a plurality of dispersedly convex points are arranged on the outer edge of a surface, facing the window screen, of the decorative part, and the top end of the first projection structure is abutted against the window screen.

A gap for allowing the snap connecting structure, which is between the window screen and the middle frame to pass through, is formed in the edge of the decorative part.

The external surface of the inner frame bulges outwards, a groove-shaped handle is formed on the internal surface of the inner frame, a notch is formed in the middle frame at a position corresponding to the position of the handle. The handle of the inner frame is matched with the decorative part through the notch and, a second projection structure is dispersedly arranged between the handle and the decorative part, and a top end of the second projection structure supports the handle or the decorative part.

The present disclosure further provides a drum washing machine with the door.

By adopting the technical scheme, the present disclosure has the following beneficial effects:

1. There is no more snap jaw on the window screen, so that the structure is simplified, the take time of production of the window screen is accelerated, thus, the production efficiency is effectively increased. And the problem that the snap jaw are prone to fracture during demolding and pickup in the injection molding production process due to material fragility and weaker strength caused by the snap jaw structures is prevented.

2. The window screen is only clamped between the outer frame and the middle frame, so that the assembly structure is simplified, the efficiency of assembly is increased. And the influence of attenuation or damage to the weld strength of the middle frame and the inner frame due to the fact that the snap jaw at the edge of the window screen apply a large pulling force or pushing force to the middle frame when the window screen is pressed during transportation or carrying-on-back is prevented.

3. The projection structures are arranged between the decorative part and the window screen, so that the surface support is changed into point support, and the noises resulting from mutual extrusion are prevented.

4. At the handle structure, the projection structures are arranged between the inner frame and the decorative part, so that the surface support is changed into point support, and the noises resulting from mutual extrusion are prevented.

5. The groove-shaped structure is arranged between the snap buckle of the window screen, the snap buckle extends between the outer frame and the middle frame and are in snapped connection with the middle frame. The edge of the groove-shaped gap supports the outer frame, the supporting surface between the window screen and the outer frame is reduced, and the noises generated by friction between the window screen and the outer frame when the window screen is pressed are prevented.

The present disclosure will be further described below in combination with the accompanying drawings and specific embodiments of the present disclosure.

Reference Sign: 1—inner frame, 2—glass tub, 3—middle frame, 4—window screen, 5—outer frame, 6—decorative part, 7—first recess, 8—second recess, 9—first snap jaw, 10—first positioning structure, 11—second positioning structure, 12—second snap jaw, 13—second snap groove, 14—first projection structure, 15—second projection structure, 16—notch, 17—handle, 18—third snap jaw, 19—third snap groove, 20—gap.

DETAILED DESCRIPTION

Figure 1:
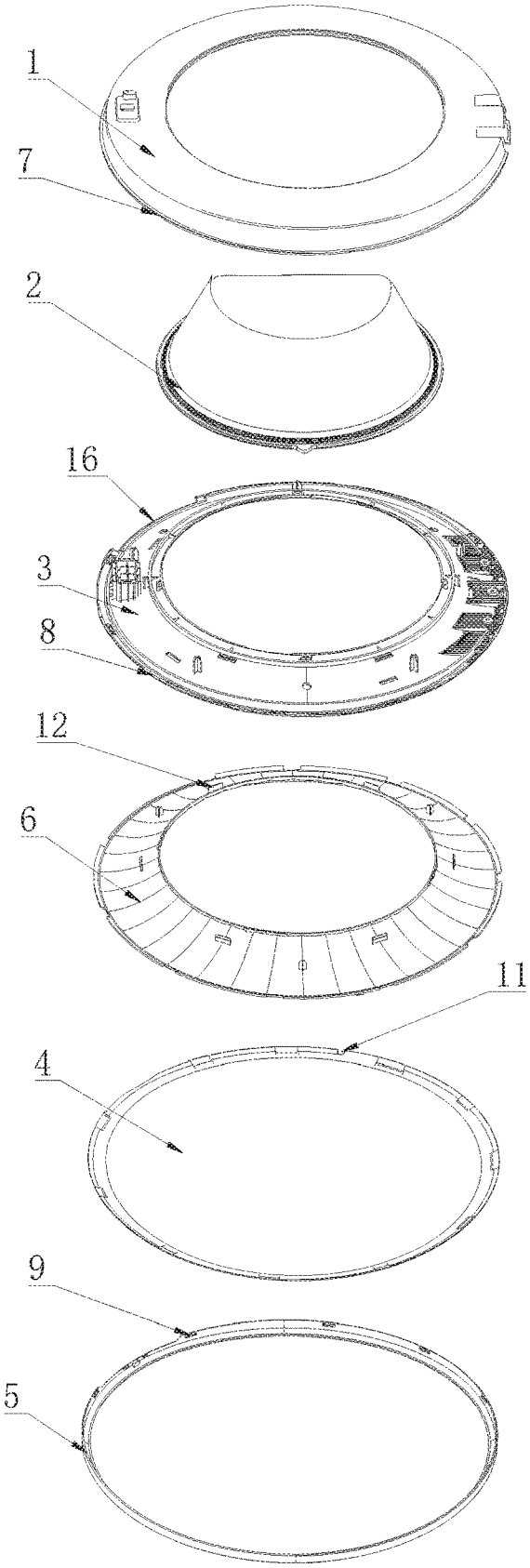
FIG. 1: an exploded view of a door of the present disclosure.
Figure 2:
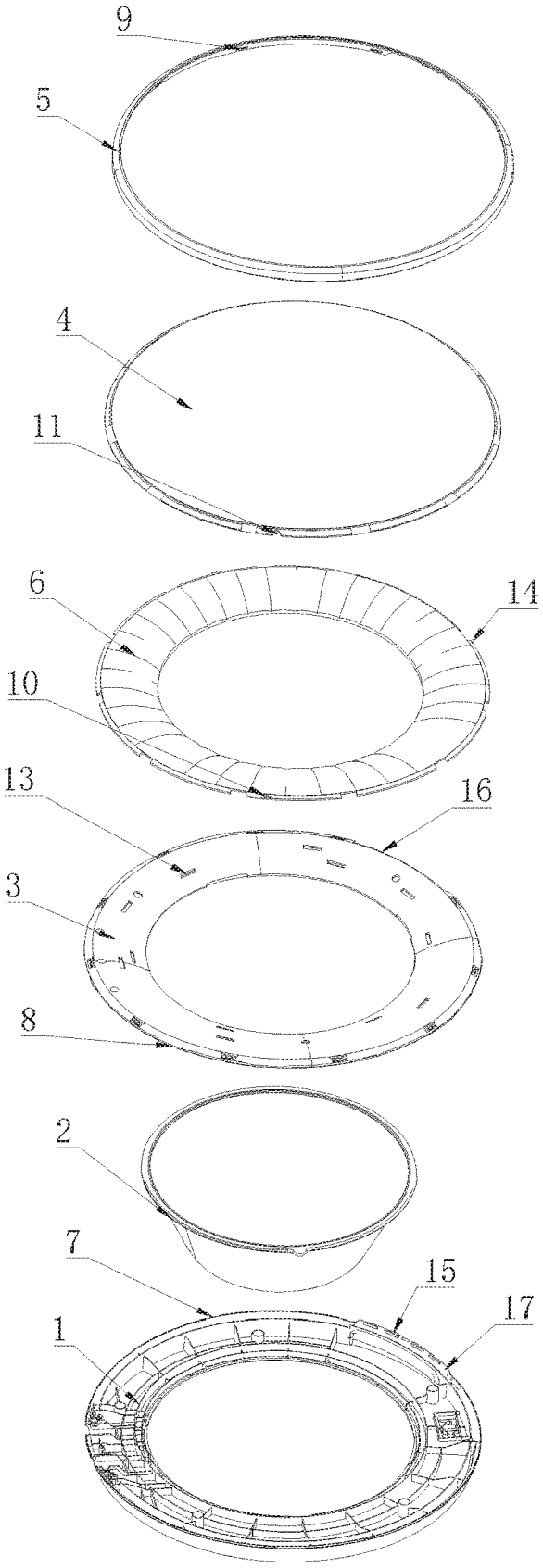
FIG. 2: an exploded view of another angle of the door of the present disclosure.
Figure 3:
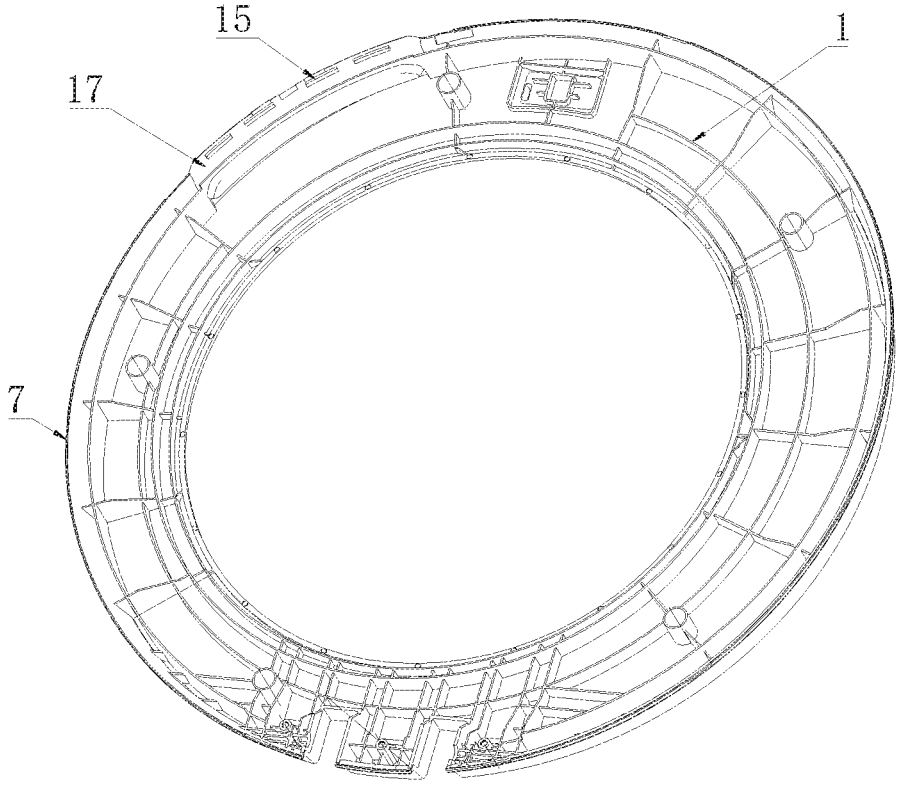
FIG. 3: a structural diagram of an inner frame of the present disclosure.
Figure 4:
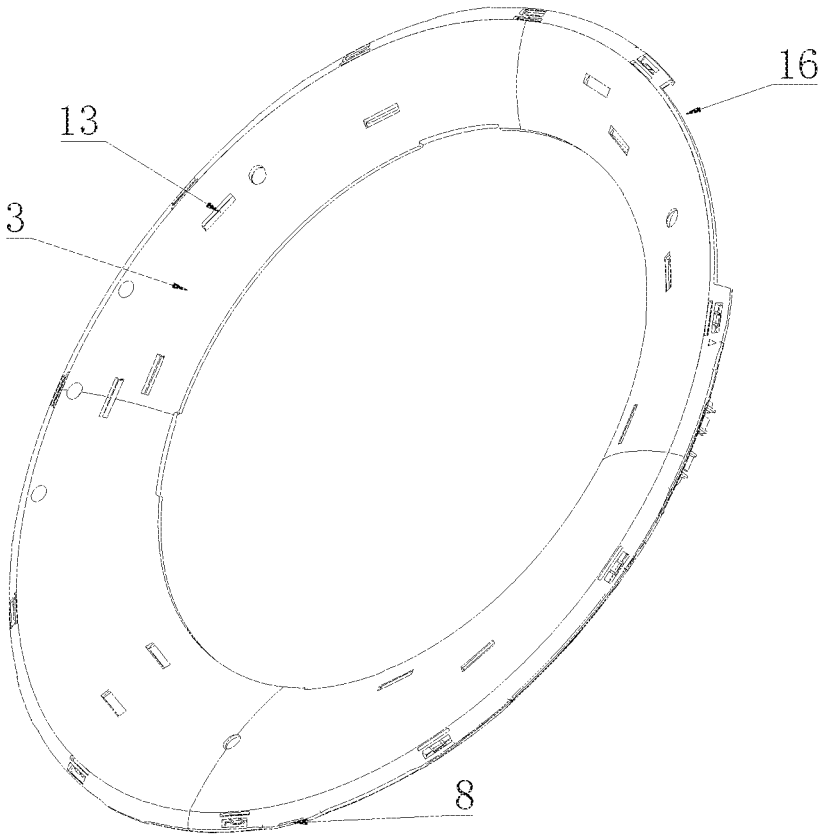
FIG. 4: a structural diagram of a middle frame of the present disclosure.
Figure 5:
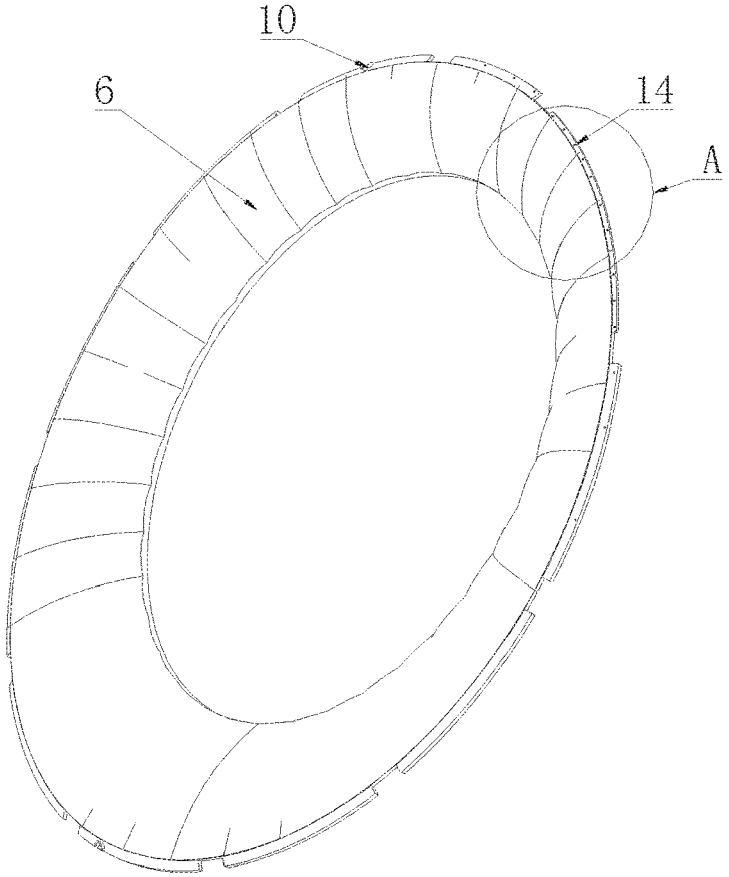
FIG. 5: a structural diagram of a decorative part of the present disclosure.
Figure 6:
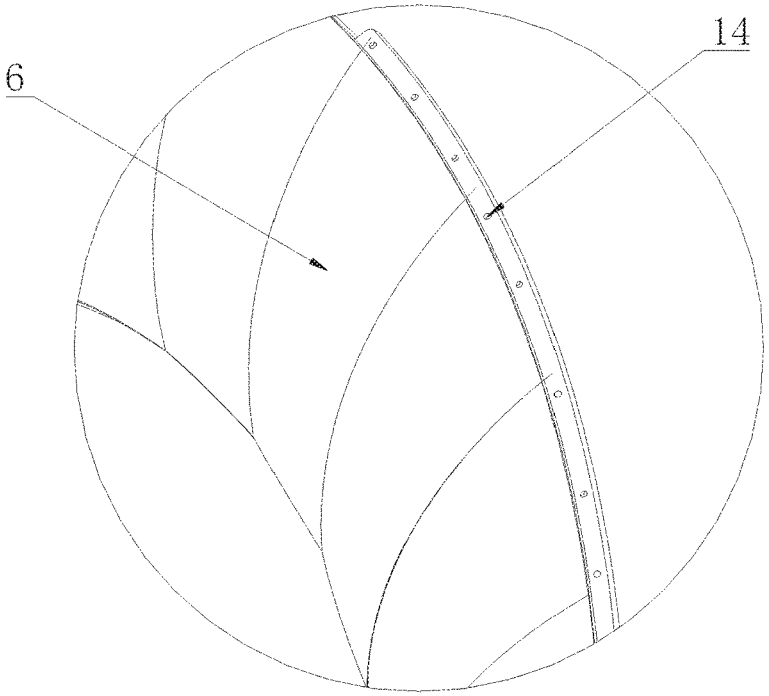
FIG. 6: an enlarged view of a portion A in FIG. 5.
Figure 7:
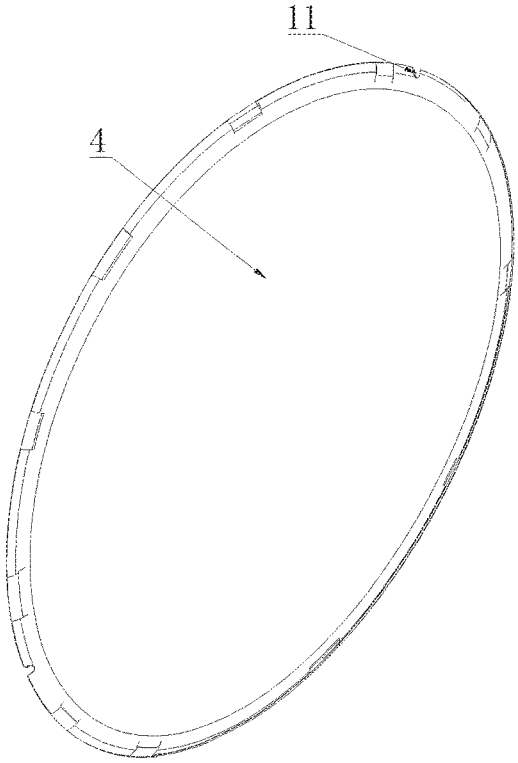
FIG. 7: a structural diagram of a window screen of the present disclosure.
Figure 8:
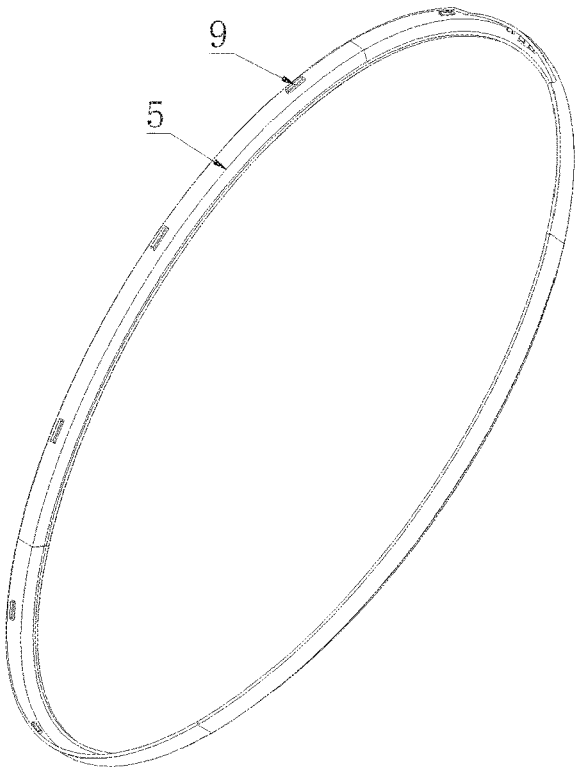
FIG. 8: a structural diagram of an outer frame of the present disclosure.

As shown in FIG. 1 to FIG. 8, a door for a drum washing machine comprises an inner frame, a transparent tub, a middle frame and an outer frame which are arranged sequentially from the inner side of the door to the outer side of the door. Wherein a window screen is arranged between the outer frame and the middle frame, the middle frame is in welded connection with the inner frame, the outer frame and the window screen are snapped onto the middle frame, and a decorative part is arranged between the window screen and the middle frame. Snap jaw structures are designed at the edge of the window screen, the snap jaw are prone to fracture during demolding and pickup in an injection molding production process due to material fragility and weaker strength, and the take time of production of the window screen is affected. The window screen is snapped onto the middle frame through the snap jaw, size control requirements on the window screen component and the middle frame component are very high, difficulty in assembly and even snap jaw fracture will be caused in case of slight deviation, and thus, the efficiency of assembly is affected. Meanwhile, even if the two components are qualified in size, all the snap jaw are required to be aligned with corresponding snap groove and be connected in a snap-in manner one by one during assembly, thus, the efficiency is lowered. And the window screen is snapped onto the middle frame through the snap jaw, thus, influence of attenuation or damage to weld strength of the middle frame and the inner frame is caused due to the fact that the snap jaw at the edge of the window screen apply a large pulling force to the middle frame when the window screen is pressed during transportation or carrying-on-back.

A door for a drum washing machine, provided by the present disclosure, comprises an inner frame 1, a glass tub 2, a middle frame 3, a window screen 4 and an outer frame 5 which are arranged sequentially from the inner side of the door to the outer side of the door. Wherein the middle frame 3 is in welded connection with the inner frame 1, the glass tub 2 is clamped between the inner frame 1 and the middle frame 3, the outer frame 5 is in snapped connection with the middle frame 3 and/or the inner frame 1, and the window screen 4 is clamped between the outer frame 5 and the middle frame 3. The window screen 4 is only clamped between the outer frame 5 and the middle frame 3 in the present disclosure, so that the assembly structure is simplified, the efficiency of assembly is increased. And the influence of attenuation or damage to the weld strength of the middle frame and the inner frame due to the fact that the snap jaw at the edge of the window screen apply a large pulling force or pushing force to the middle frame when the window screen is pressed during transportation or carrying-on-back is prevented. Meanwhile, there is no snap jaw on the window screen, so that the structure is simplified, the take time of production of the window screen is increased, thus, the production efficiency is effectively accelerated, and the problem that the snap jaw are prone to fracture during demolding and pickup in the injection molding production process due to material fragility and weaker strength caused by the snap jaw structures is prevented.

The middle frame 3 and the inner frame 1 are matched with each other to form the first snap groove, and the first snap jaw 9 are arranged on the outer frame 5 and is in snapped connection with the first snap groove to connect the outer frame 5, the middle frame 3 and the inner frame 1 together. The outer frame 5 is simultaneously connected with the middle frame 3 and the inner frame 1, and stress of the outer frame 5 is simultaneously transferred to the inner frame 1 and the middle frame 3. Compared with that the outer frame 5 is connected with either the middle frame 3 or the inner frame 1 and the stress of the outer frame 5 is transferred to the inner frame 1 or the middle frame 3, so that stress of the inner frame 1 and stress of the middle frame 3 are more average, the magnitude of separate stress is reduced, and service lives of components and parts are prolonged.

A first recess 7 is formed at the outer circumference of a surface, facing the middle frame 3, of the inner frame 1, a second recess 8 is formed at the outer circumference of a surface, facing the inner frame 1, of the middle frame 3. The first recess 7 and the second recess 8 are aligned with each other to form the first snap groove, after the middle frame 3 is connected with the inner frame 1. The first snap jaw 9 is arranged at the outer circumference of the outer frame 5 and is in snapped connection with the first snap groove formed by the inner frame 1 and the middle frame 3. The structure is simple, and snap groove for snapped connection of the outer frame can be formed by only separately forming the recesses in opposite surfaces of the inner frame 1 and the middle frame 3 after the recesses are matched with each other. So that compared with that the snap groove is structurally formed in either the inner frame 1 or the middle frame 3, the inner frame and the middle frame with the structure in the present disclosure is more easily processed. Meanwhile, the outer frame 5 is simultaneously connected with the middle frame 3 and the inner frame 1, the stress of the outer frame 5 is simultaneously transferred to the inner frame 1 and the middle frame 3, the stress of the inner frame 1 and the stress of the middle frame 3 are more average, the magnitude of separate stress is reduced, and the service lives of the components and parts are prolonged.

A decorative part 6 is further arranged between the middle frame 3 and the window screen 4 and is in snapped connection with the middle frame 3. The decorative part 6 is preferably of an annular structure and blocks the edge part and corners of the glass tub 2, and thus users can see a simpler door window. The surface, facing the outer side of the door, of the decorative part 6 can be made into a structure of any shape, so that the diversity of the washing machine is improved, and the design can be changed according to user requirements to meet the requirements of different people on aesthetic appreciation.

A first positioning structure 10 for the window screen 4 is arranged on the middle frame 3 or decorative part 6, a second positioning structure 11 is arranged on the window screen 4, and the first positioning structure 10 and the second positioning structure 11 are matched with each other for positioning. Specifically, an opening (arc-shaped, triangular, etc.) is formed in the outer edge of the window screen 4 and is applied to the assembly positioning of the window screen 4 and the decorative part, and a structure shape matched with the opening in the outer edge of the window screen 4 is formed on the outer edge of the decorative part 6 and is applied to the assembly positioning of the window screen 4 and the decorative part 6. The window screen 4 cannot circumferentially rotate after being positioned, and the window screen can be fixed firmly due to the extruding of the middle frame 3 and the outer frame 5.

A second snap jaw 12/second snap groove 13 are arranged on the surface, facing the middle frame 3, of the decorative part 6, and a second snap groove 13/second snap jaw 12 are formed in the surface, facing the decorative part 6, of the middle frame 3, and the second snap jaw 12/second snap groove 13 is in snapped connection with the second snap groove 13/second snap jaw 12. The decorative part 6 is in snapped connection with the middle frame 3, assembly can be completed by only matching the second snap jaw 12/second snap groove 13 of the decorative part 6 to the second snap groove 13/second snap jaw 12 of the inner frame 1 and then pressing the decorative part 6 during assembling, and the disassembly is simple.

A first projection structure 14 is arranged between the decorative part 6 and the window screen 4, a top end of the first projection structure 14 supports the decorative part 6 or window screen 4. The majority of the decorative part 6 and the majority of the window screen 4 are plastic parts, some degree of deformation will be generated during pressing. When the window screen 4 is pressed if the decorative part 6 and the window screen 4 are in surface contact, the window screen 4 will deform and will be in friction with the decorative part 6 and squeak noises are generated. In the present disclosure, the first projection structure 14 is arranged between the decorative part 6 and the window screen 4, the top end of the first projection structure 14 supports the decorative part 6 or window screen 4, and the surface contact between the decorative part 6 and the window screen 4 is changed into point contact, so that the surface of contact is reduced, and the noises resulting from mutual extrusion are prevented. The projection structures are preferably semispherical projections, and top ends of semispheres support the decorative part or window screen.

Preferably, a plurality of dispersedly convex points are arranged on the outer edge of a surface, facing the window screen 4, of the decorative part 6, and the top end of the first projection structure 14 is abutted against the window screen 4. Preferably, the space between every two adjacent first projection structures 14 is able to stably support the window screen and also can be used for preventing the noises during mutual extrusion.

Or, a plurality of dispersedly first projection structures 14 are arranged on the outer edge of a surface, facing the decorative part 6, of the window screen 4, and the top end of the first projection structure 14 is abutted against the decorative part 6; and the space between every two adjacent first projection structures 14 can stably support the decorative part and also can be used for preventing the noises during mutual extrusion. In this case, the surface, facing the window screen, of the decorative part is a flat surface to the best.

The external surface of the inner frame 1 bulges outwards, and the bulge forms a groove-shaped handle 17 the internal surface of the inner frame 1, so that a user can conveniently open the door; and an notch 16 is formed in the middle frame 3 at a position corresponding to the position of the bulge, and the bulge of the inner frame 1 is matched with the decorative part 6 through the notch 16. A second projection structure 15 which is dispersedly arranged between the bulge and the decorative part, and the top end of the second projection structure 15 supports the bulge or decorative part. A user needs to apply a larger force to open the door, the inner frame is extruded during force applying, the bulge of the inner frame deforms and will be in friction with the decorative part if the inner frame and the decorative part are in surface contact, and the squeak noises are generated. And the second projection structure 15 is arranged between the decorative part and the bulge of the inner frame, the top end of the second projection structure 15 supports the decorative part 6 or the bulge of the inner frame, and the surface contact between the decorative part 6 and the bulge of the inner frame 1 is changed into point contact, so that the surface of contact is reduced, and the noises resulting from mutual extrusion are prevented. The projection structures are preferably semispherical projections or long-strip projections, and top ends of the projection structures support the decorative part 6 or window screen 4. Preferably, the second projection structure 15 is arranged on a surface, facing the decorative part 6, of the bulge, the top end of the second projection structure 15 support the decorative part 6, and the surface contact between the decorative part 6 and the bulge of the inner frame 1 is changed into point contact, so that the surface of contact is reduced, and the noises resulting from mutual extrusion are prevented.

According to a drum washing machine with the door, provided by the present disclosure, the door is hinged to one side of a front opening of the drum washing machine, the deformation is low when the door is extruded or opened, and the door is free of noises. Due to an internal connection structure of the door, internal stress of the door is dispersedly, the stress is uniform, and thus, the service life of the door, service lives of the components, and parts are prolonged.

Figure 9:
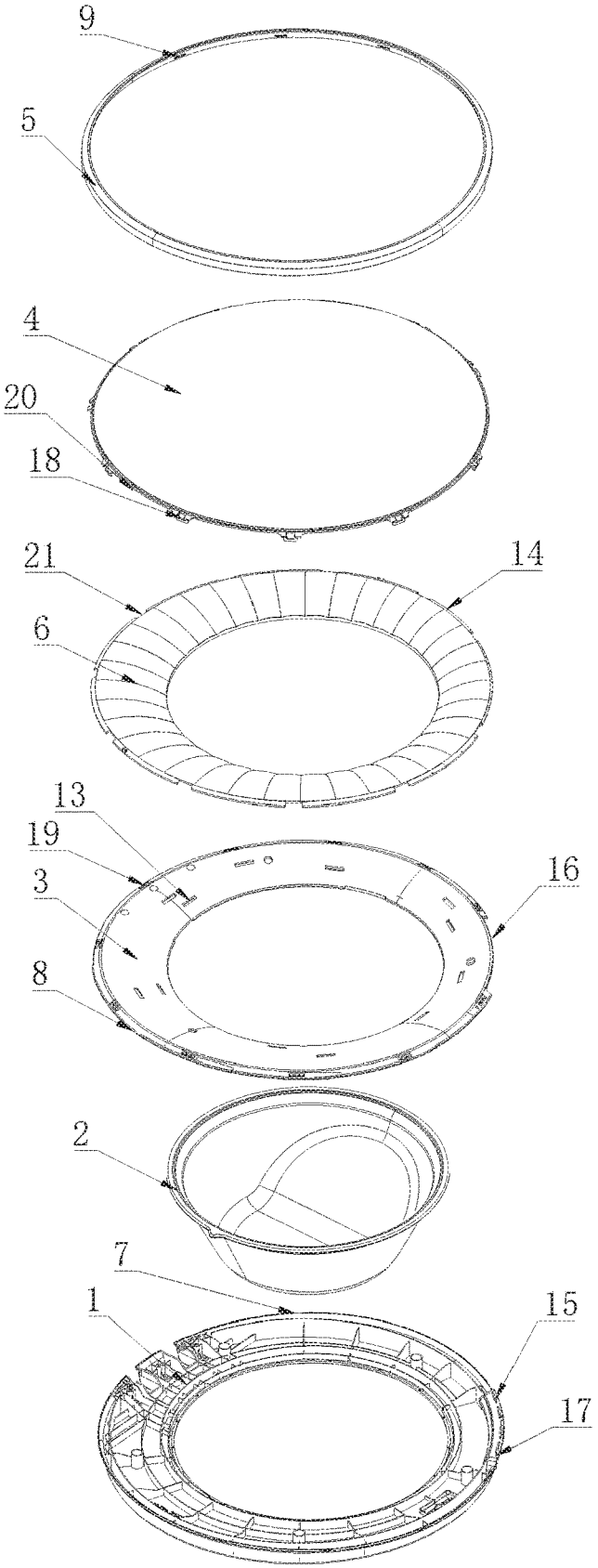
FIG. 9: an exploded view of a door of the present disclosure.
Figure 10:
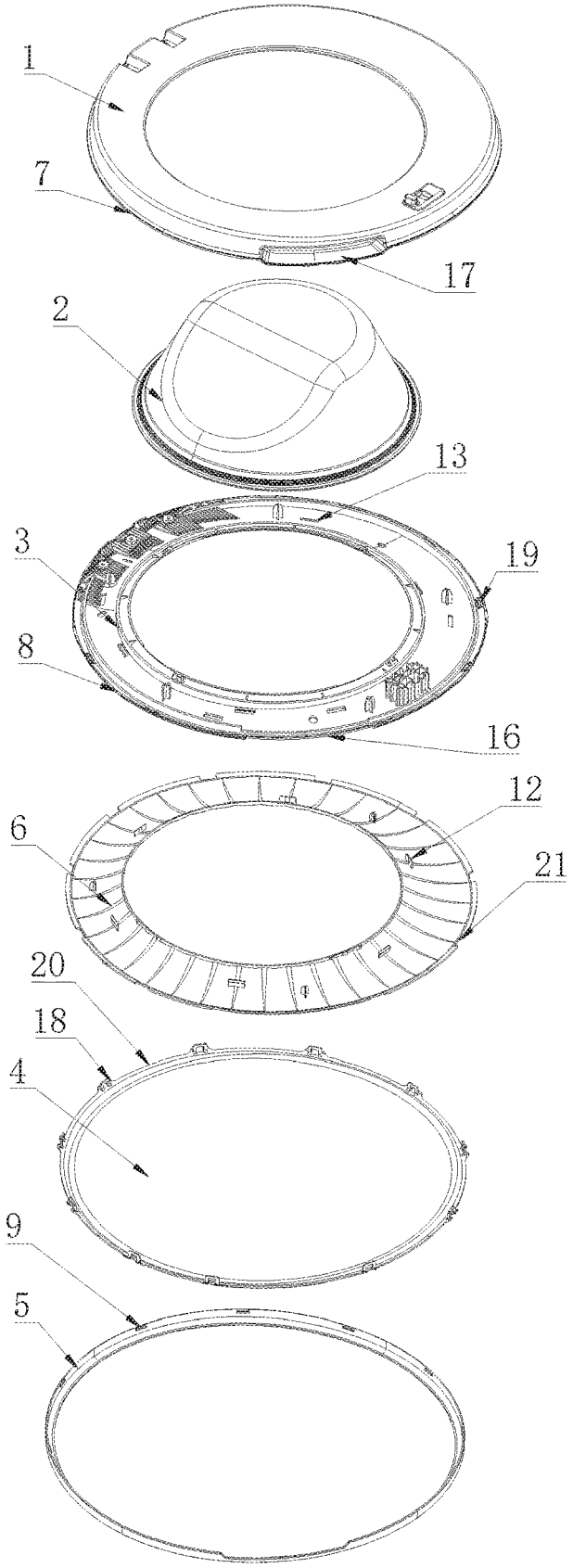
FIG. 10: an exploded view of another angle of the door of the present disclosure.
Figure 11:
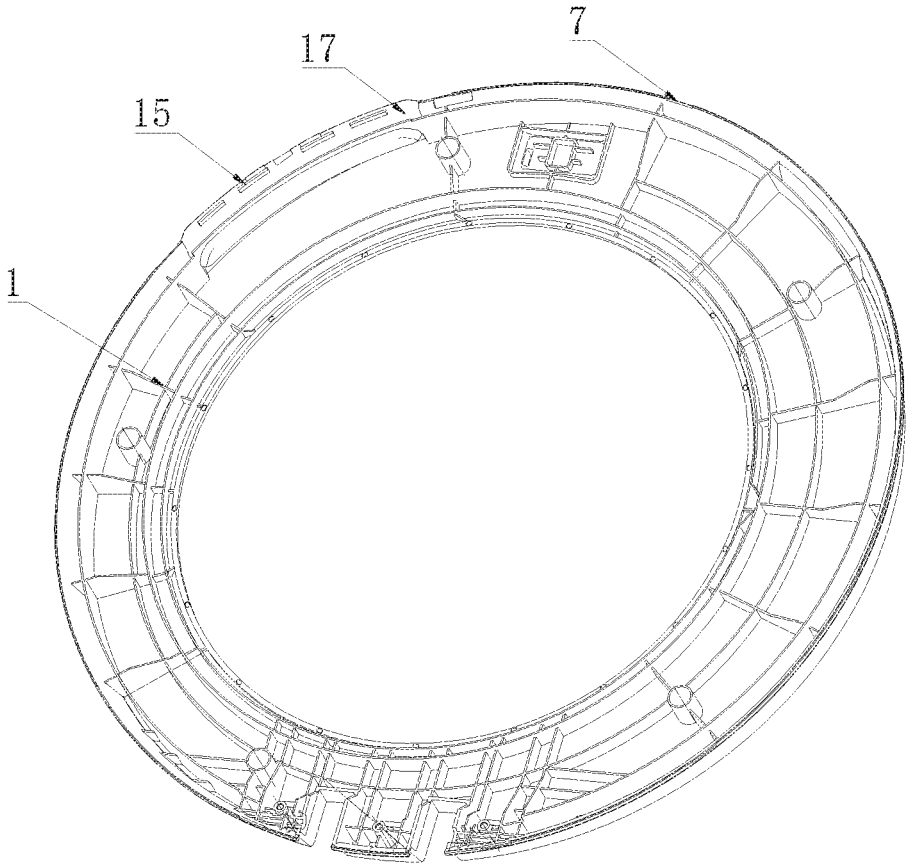
FIG. 11: a structural diagram of an inner frame of the present disclosure.
Figure 12:
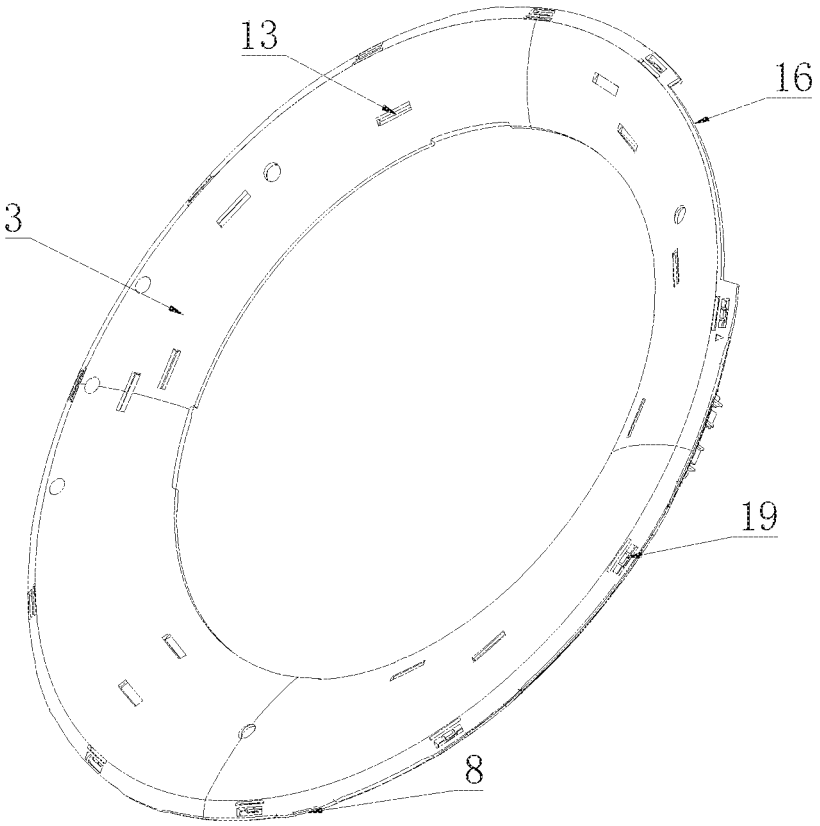
FIG. 12: a structural diagram of a middle frame of the present disclosure.
Figure 13:
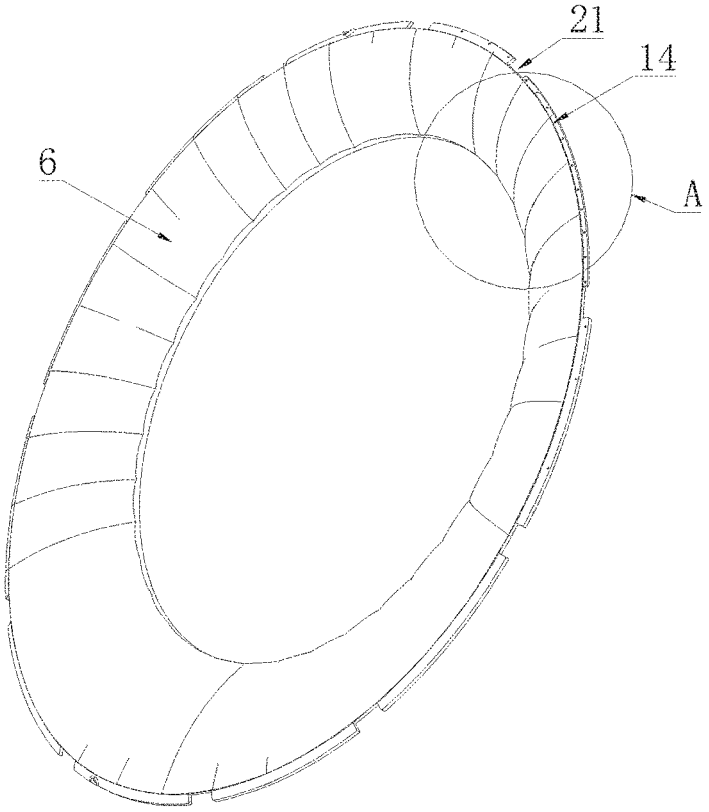
FIG. 13: a structural diagram of a decorative part of the present disclosure.
Figure 14:
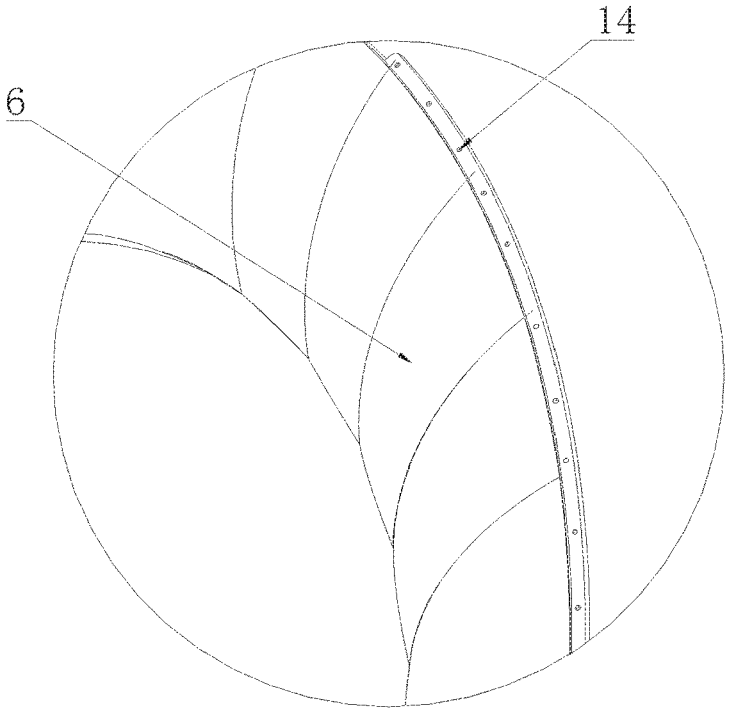
FIG. 14: an enlarged view of a portion A in FIG. 5.
Figure 15:
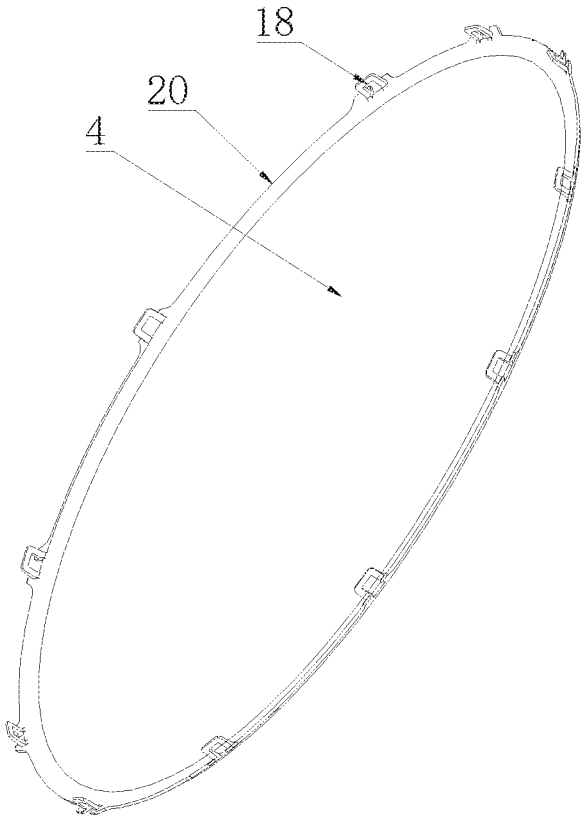
FIG. 15: a structural diagram of a window screen of the present disclosure.
Figure 16:
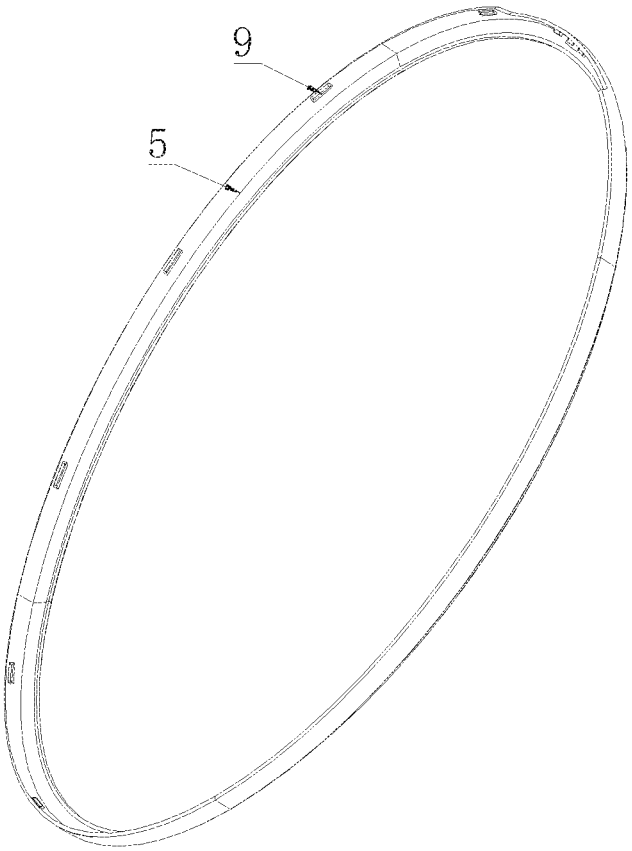
FIG. 16: a structural diagram of an outer frame of the present disclosure.

As shown in FIG. 9 to FIG. 16, a door for a drum washing machine generally comprises an inner frame, a transparent tub, a middle frame and an outer frame which are arranged sequentially from the inner side of the door to the outer side of the door. Wherein a window screen is arranged between the outer frame and the middle frame, the middle frame is in welded connection with the inner frame, the outer frame and the window screen are snapped onto the middle frame, a decorative part is arranged between the window screen and the middle frame. A snap jaw is arranged at the outer periphery of the window screen, edge parts are basically the same in diameter and directly extend to the edge of the internal wall of the outer frame, thus, noises are generated due to the fact that the window screen is subjected to stress deformation and is in relative kinetic friction with the internal wall of the outer frame when the window screen is pressed.

In order to solve the above-mentioned problem, a door for a drum washing machine, provided by the present disclosure, comprises an inner frame 1, a glass tub 2, a middle frame 3, a window screen 4 and an outer frame 5 which are arranged sequentially from the inner side of the door to the outer side of the door. Wherein the middle frame 3 is in welded connection with the inner frame 1, the glass tub 2 is clamped between the inner frame 1 and the middle frame 3, the outer frame 5 is in snapped connection with the middle frame 3 and/or the inner frame 1, the window screen 4 is in snapped connection with the middle frame 3. Snap connecting structures which are in snapped connection with the middle frame 3 are arranged on the outer periphery of a surface, facing the middle frame 3, of the window screen 4, and groove-shaped gaps 20 are formed between adjacent snap connecting structures. The snap connecting structures extend into the middle frame 3 and are in snapped connection with the middle frame 3, edges of the groove-shaped gaps 20 support the outer frame 5, a supporting surface between the window screen 4 and the outer frame 5 is reduced, and the noises generated by friction between the window screen 4 and the outer frame 5 when the window screen 4 is pressed are prevented.

The snap connecting structures are as follows: a third snap jaw 18/a third snap groove 19 is arranged at the outer periphery of a surface, facing the middle frame 3, of the window screen 4, and the third snap groove 19/the third snap jaw 18 is formed in the outer periphery of a surface, facing the window screen 4, of the middle frame 3. The third snap jaw 18/the third snap groove 19 is in snapped connection with the third snap groove 19/the third snap jaw 18.

The groove-shaped gaps 20 are formed by removing circumference parts, between adjacent snap connecting structures, of the window screen 4, or the groove-shaped gaps are formed by the snap connecting structures extending out of the circumference parts of the window screen 4. In order to guarantee the strength of snapped connection between the snap connecting structures and the middle frame 3, part of edge is reserved at the periphery of each snap connecting structure, the edge of the circumference of the window screen 4 of other places is partially removed. And the snap connecting structures extend into the middle frame 3 and are in snapped connection with the middle frame 3, and the edges of the groove-shaped gaps 20 support the outer frame 5. In this way, the surface of contact between the edge of the window screen 4 and the outer frame 5 is greatly reduced, and original surface support is changed into local dispersedly support, so that the noises generated by the friction between the window screen and the outer frame when the window screen is pressed are lowered.

The width of the edge, supporting the outer frame 5, of each groove-shaped gap 20 is 15 mm-25 mm, preferably 24 mm. Thus, the strength of supporting can be guaranteed, the surface of contact between the edge of the window screen and the outer frame can be reduced to the maximum, and the noises generated by the friction between the window screen and the outer frame 5 when the window screen 4 is pressed are lowered to the utmost extent.

The middle frame 3 and the inner frame 1 are matched with each other to form the first snap groove, and the first snap jaw 9 is arranged on the outer frame 5 and are in snapped connection with the first snap groove to connect the outer frame 5, the middle frame 3 and the inner frame 1 together. The outer frame 5 is simultaneously connected with the middle frame 3 and the inner frame 1, and stress of the outer frame 5 is simultaneously transferred to the inner frame 1 and the middle frame 3, so that compared with that the outer frame 5 is connected with either the middle frame 3 or the inner frame 1 and the stress of the outer frame 5 is transferred to the inner frame 1 or the middle frame 3, stress of the inner frame 1 and stress of the middle frame 3 are more average, the size of separate stress is reduced, and service lives of components and parts are prolonged.

A first recess 7 is formed at the outer circumference of a surface, facing the middle frame, of the inner frame, a second recess 8 is formed at the outer circumference of a surface, facing the inner frame 1, of the middle frame 3. The first recess 7 and the second recess 8 are aligned with each other to form the first snap groove, of which openings face the circumference, after the middle frame 3 is connected with the inner frame 1. The first snap jaw 9 is arranged at the outer circumference of the outer frame 5 and is in snapped connection with the first snap groove formed by the inner frame 1 and the middle frame 3. The structure is simple, and snap grooves for snapped connection of the outer frame can be formed by only separately forming the recesses in opposite surfaces of the inner frame 1 and the middle frame 3 after the recesses are matched with each other. So that compared with that snap grooves are structurally formed in either the inner frame or the middle frame, the inner frame and the middle frame with the structure in the present disclosure are more easily processed. Meanwhile, the outer frame is simultaneously connected with the middle frame and the inner frame, the stress of the outer frame is simultaneously transferred to the inner frame and the middle frame, the stress of the inner frame and the stress of the outer frame are more average, the size of separate stress is reduced, and the service lives of the components and parts are prolonged.

A decorative part 6 is further arranged between the middle frame 3 and the window screen 4 and is in snapped connection with the middle frame 3. The decorative part 6 is preferably of an annular structure and blocks the edge and corners of the glass tub 2, and thus users can see a simpler door window. And a surface, facing the outer side of the door, of the decorative part 6 can be made into a structure of any shape, so that the diversity of the washing machine is improved, and the design can be changed according to user requirements to meet the requirements of different people on aesthetic appreciation.

Gaps 20 for allowing the snap connecting structures between the window screen 4 and the middle frame 3 to pass through are formed in the edge of the decorative part 6, and the snap connecting structures of the window screen 4 pass through the gaps 20 and are in snapped connection with the middle frame 3.

A second snap jaw 12/second snap groove 13 is arranged on a surface, facing the middle frame 3, of the decorative part 6, the second snap groove 13/the second snap jaw 12 is formed in a surface, facing the decorative part, of the middle frame 3, and the second snap jaw 12/second snap groove 13 is in snapped connection with the second snap groove 13/second snap jaw 12. The decorative part 6 is in snapped connection with the middle frame 3, assembly can be completed by only matching the second snap jaw 12/the second snap groove 13 of the decorative part 6 to the second snap groove 13/second snap jaw 12 of the inner frame 1 and then pressing the decorative part 6 during assembling, and the disassembly is simple.

A first projection structure 14 is arranged between the decorative part 6 and the window screen 4, a top end of the first projection structure 14 supports the decorative part 6 or window screen 4. The majority of the decorative part 6 and the majority of the window screen 4 are plastic parts, some degree of deformation will be generated during pressing. When the window screen 4 is pressed if the decorative part 6 and the window screen 4 are in surface contact, the window screen will 4 deform and will be in friction with the decorative part 6 and squeak noises are generated. In the present disclosure, the first projection structure 14 is arranged between the decorative part 6 and the window screen 4, the top end of the first projection structure 14 supports the decorative part 6 or window screen 4, and the surface contact between the decorative part 6 and the window screen 4 is changed into point contact, so that the surface of contact is reduced, and the noises resulting from mutual extrusion are prevented. The first projection structure is preferably of semispherical projections, and top ends of semispheres support the decorative part or window screen.

Preferably, a plurality of dispersedly convex points are arranged on the outer edge of a surface, facing the window screen 4, of the decorative part 6, and the top end of the first projection structure 14 is abutted against the window screen 4. Preferably, the space between every two adjacent first projection structures 14 is able to stably support the window screen 4 and also can be used for preventing the noises during mutual extrusion.

Or, a plurality of dispersedly convex points are arranged on the outer edge of a surface, facing the decorative part 6, of the window screen 4, and the top end of the first projection structure 14 is abutted against the decorative part 6; the space between every two adjacent first projection structures is able to stably support the decorative part and also can be used for preventing the noises during mutual extrusion. In this case, the surface, facing the window screen, of the decorative part is a flat surface to the best.

The external surface of the inner frame 1 bulges outwards, and the bulge forms a groove-shaped handle 17 the internal surface of the inner frame, so that a user can conveniently open the door; and an notch 16 is formed in the middle frame at a position corresponding to the position of the handle 17, and a bulge of the inner frame 1 is matched with the decorative part 6 through the notch 16. A second projection structure 15 is dispersedly arranged between the handle 17 and the decorative part 6, and the top end of the second projection structure 15 supports the handle or decorative part. A user needs to apply a larger force to open the door, the inner frame 1 is extruded during force applying, the bulge of the inner frame deforms and will be in friction with the decorative part if the inner frame 1 and the decorative part 6 are in surface contact, and the squeak noises are generated And the second projection structure 15 is arranged between the decorative part and the bulge of the inner frame, the top end of the second projection structure 15 supports the decorative part or the bulge of the inner frame, and the surface contact between the decorative part and the bulge of the inner frame is changed into point contact, so that the surface of contact is reduced, and the noises resulting from mutual extrusion are prevented. The projection structures are preferably of semispherical bulges, and top ends of semispheres support the decorative part or window screen. Preferably, the second projection structure is arranged on a surface, facing the decorative part, of the bulge, the top end of the second projection structure supports the decorative part, and the surface contact between the decorative part and the bulge of the inner frame is changed into point contact, so that the surface of contact is reduced, and the noises resulting from mutual extrusion are prevented.

According to a drum washing machine with the door, provided by the present disclosure, the door is hinged to one side of a front opening of the drum washing machine, the deformation is low when the door is extruded or opened, and the door is free of noises. Due to an internal connection structure of the door, internal stress of the door is dispersedly, the stress is uniform, and thus, the service life of the door, service lives of the components, and parts are prolonged.

What described above are only preferred embodiments of the present disclosure, and it should be noted that, without departing from the principle of the present disclosure, various changes and modifications made by those skilled in the art shall all be covered within the scope of the present disclosure.

The invention claimed is:

1. A door for a drum washing machine, comprising an inner frame, a glass tub, a middle frame, a window screen and an outer frame which are arranged sequentially from an inner side of the door to an outer side of the door, wherein the middle frame is in welded connection with the inner frame, the glass tub is clamped between the inner frame and the middle frame, the outer frame is in snapped connection with the middle frame and/or the inner frame, and the window screen is clamped between the outer frame and the middle frame, the middle frame and the inner frame are matched with each other to form a first snap groove, and a first snap jaw is arranged on the outer frame, and the first snap jaw is in snapped connection with the first snap groove to connect the outer frame, the middle frame and the inner frame together.

2. The door for the drum washing machine according to claim 1, wherein a first recess is formed at an outer circumference of a surface, facing the middle frame, of the inner frame, a second recess is formed at an outer circumference of a surface, facing the inner frame, of the middle frame, after the middle frame is connected with the inner frame, the first recess and the second recess are aligned with each other to form the first snap groove, of which an opening faces a circumference, and the first snap jaw is arranged at an outer circumference of an outer frame and the first snap jaw is in snapped connection with the first snap groove formed by the inner frame and the middle frame.

3. The door for the drum washing machine according to claim 1, wherein a decorative part is arranged between the middle frame and the window screen, and the decorative part is in snapped connection with the middle frame.

4. The door for the drum washing machine according to claim 3, wherein a first positioning structure for the window screen is arranged on the middle frame/decorative part, a second positioning structure is arranged on the window screen, and the first positioning structure and the second positioning structure are matched with each other for positioning.

5. The door for the drum washing machine according to claim 3, wherein one of a second snap jaw and a second snap groove is arranged on a surface facing the middle frame of the decorative part, and an other of the second snap groove and the second snap jaw is formed in a surface facing the decorative part of the middle frame, and the one of the second snap jaw and the second snap groove is in snapped connection with the other of the second snap jaw and the second snap groove.

6. The door for the drum washing machine according to claim 3, wherein a first projection structure is arranged between the decorative part and the window screen, a top end of the first projection structure supports the decorative part or the window screen.

7. The door for the drum washing machine according to claim 6, wherein a plurality of dispersedly convex points are arranged on an outer edge of a surface, facing the window screen, of the decorative part, and the top end of the first projection structure is abutted against the window screen.

8. The door for the drum washing machine according to claim 3, wherein an external surface of the inner frame bulges outwards, a handle with groove shape is formed on an internal surface of the inner frame, a notch is formed in the middle frame at a position corresponding to the handle, and the handle of the inner frame is matched with the decorative part through the notch.

9. The door for the drum washing machine according to claim 8, wherein a second projection structure is dispersedly arranged between the handle and the decorative part, and a top end of the second projection structure supports the handle or the decorative part.

10. The door for the drum washing machine according to claim 1, wherein a snap connecting structure through which the window screen is in snapped connection with the middle frame is arranged on an outer periphery of a surface, facing the middle frame, of the window screen, and a groove-shaped gap is formed between the adjacent snap connecting structures.

11. The door for the drum washing machine according to claim 10, wherein the groove-shaped gap is formed by removing circumference parts, between the adjacent snap connecting structures, of the window screen, or the groove-shaped gap is formed by the snap connecting structures extending out of the circumference parts of the window screen.

12. The door for the drum washing machine according to claim 10, wherein the snap connecting structure extends into the middle frame and is in snapped connection with the middle frame, and an edge of the groove-shaped gap supports the outer frame.

13. The door for the drum washing machine according to claim 10, wherein one of a third snap jaw and a third snap groove is arranged at the outer periphery of the surface facing the middle frame of the window screen, and an other of the third snap groove and the third snap jaw is formed in an outer periphery of a surface facing the window screen of the middle frame, and the one of the third snap jaw and the third snap groove is in snapped connection with the other of the third snap jaw and the third snap groove.

14. The door for the drum washing machine according to claim 10, wherein a first recess is formed at an outer circumference of a surface, facing the middle frame, of the inner frame, a second recess is formed at an outer circumference of a surface, facing the inner frame, of the middle frame, after the middle frame is connected with the inner frame, the first recess and the second recess are aligned with each other to form the first snap groove, of which an opening faces a circumference, and the first snap jaw is arranged at an outer circumference of the outer frame and the first snap jaw is in snapped connection with the first snap groove formed by the inner frame and the middle frame.

15. The door for the drum washing machine according to claim 10, wherein a decorative part is arranged between the middle frame and the window screen, the decorative part is in snapped connection with the middle frame, a first projection structure is arranged between the decorative part and the window screen, and a top end of the first projection structure supports the decorative part or window screen.

16. The door for the drum washing machine according to claim 10, wherein a gap for allowing the snap connecting structure between the window screen and the middle frame to pass through is formed in an edge of the decorative part.

17. The door for the drum washing machine according to claim 10, wherein an external surface of the inner frame bulges outwards, a handle with groove shape is formed on an internal surface of the inner frame, a notch is formed in the middle frame at a position corresponding to the handle, the handle of the inner frame is matched with the decorative part through the notch, a second projection structure is dispersedly arranged between the handle and the decorative part, and a top end of the second projection structure supports the handle or decorative part.

18. A drum washing machine with the door according to claim 1.

* * * * *